US005842278A

United States Patent [19]

Gmeilbauer

[11] Patent Number: 5,842,278

[45] Date of Patent: Dec. 1, 1998

[54] HAND-HELD OSCILLATION MACHINE

[76] Inventor: Engelbert Gmeilbauer, Stocketweg 1, DE-82229 Seefeld, Germany

[21] Appl. No.: 555,637

[22] Filed: Nov. 8, 1995

[30] Foreign Application Priority Data

Nov. 8, 1994 [DE] Germany ..... G 94 17 859.3
Aug. 24, 1995 [DE] Germany ..... 195 31 270.8

[51] Int. Cl.[6] ..... B26B 7/00; B24B 23/00

[52] U.S. Cl. ..... 30/277.4; 30/272.1

[58] Field of Search ..... 76/82; 30/169, 30/166.3, 392, 272.1, 277.4, 329

[56] References Cited

U.S. PATENT DOCUMENTS

| | | | |
|---|---|---|---|
| 3,754,330 | 8/1973 | Anderson et al. | 30/392 |
| 3,973,444 | 8/1976 | Skinner . | |
| 4,852,261 | 8/1989 | Wittek | 30/277.4 |
| 4,980,976 | 1/1991 | Junginger et al. | 30/272.1 |
| 5,038,478 | 8/1991 | Mezger et al. | 30/272.1 |
| 5,058,273 | 10/1991 | Streger . | |

FOREIGN PATENT DOCUMENTS

| | | |
|---|---|---|
| 0339357 | 11/1989 | European Pat. Off. . |
| 2534515 | 4/1984 | France . |

*Primary Examiner*—Hwei-Slu Payer
*Attorney, Agent, or Firm*—Cohen, Pontani, Lieberman & Pavane

[57] ABSTRACT

A hand-held oscillation machine having, at its front end, an attachment neck for tools. A component such as a flattened hexagon projection and a radial screw, is provided at the rear flat side of the neck for receiving and attaching special tools so as to be fixed with respect to rotation relative thereto. An oscillating body/intermediate holder is arranged between the attachment neck and a tool. This provides the advantage that all grinding tools and cutting tools for hand drills can be attached in the intermediate holder and can accordingly be used, and the sturdy, heavy design of the intermediate holder increases the oscillating energy so that greater pressure can be exerted on the workpiece to be machined, which enables faster machining.

9 Claims, 2 Drawing Sheets

FIG. 3
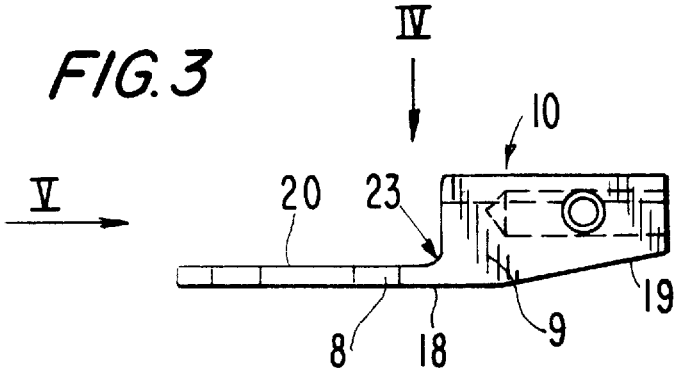
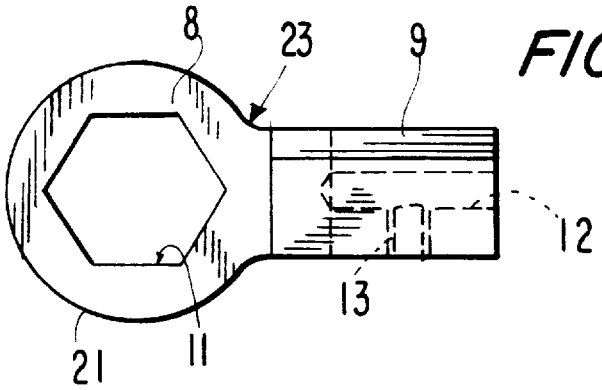
FIG. 4
FIG. 5
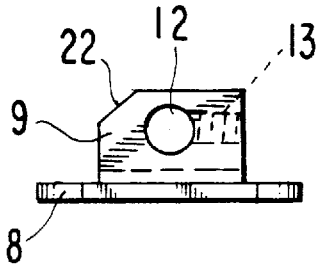

HAND-HELD OSCILLATION MACHINE

BACKGROUND OF THE INVENTION

1. Filed of the Invention

The invention is directed to a hand-held oscillation machine such as that used, for example, in combination with corresponding cutting knives or the like special tools.

2. Description of the Prior Art

Hand-held oscillation machines of this type have a front attachment neck at which a tool, e.g., a cutting knife, is clamped on a special holder. This clamping is effected, for example, in that the cutting knife has a plate-shaped holding part with a hexagon opening which can be placed on a lateral hexagon projection of the attachment neck. The tool attachment part is then tightened by means of a screw. Only tools which have been designed specifically for this machine, in particular with respect to the attachment part, can be used with the known hand-held oscillation machine. The selection of accessory tools is therefore relatively limited and the prices of such tools are also relatively high. Further, work can only be performed relatively slowly because when greater pressure is applied to the workpiece to be machined the accessory tool remains stationary while the machine which is held in the hand continues to oscillate.

SUMMARY OF THE INVENTION

The object of the present invention is to provide a hand-held oscillation machine of the generic type mentioned above which can utilize commercially available grinding accessories and cutting accessories for drilling machines, provided such accessories are suitable for this purpose, and which increases the working speed compared to the prior art in a simple manner.

Purreant to this object the present invention provides a hand-held oscillation machine having an oscillating intermediate holder arranged between the attachment neck and the tool.

Due to this, an oscillating body/intermediate holder arranged between the attachment neck and the tool, practically all grinding and cutting accessory tools for drilling machines which are designed to be received in a conventional drill chuck can now also be used for machines with oscillating drives. The sturdy and accordingly also heavy construction of the intermediate holder increases the oscillating force so that greater pressure can be exerted on the workpiece to be machined. This enables faster work.

The intermediate holder is preferably cut from one piece and is substantially formed of a flat, rounded, disk-like attachment part for the machine holder, this attachment part being provided with a hexagon opening, and a relatively thick mass body which is connected thereto and which contains a receiving bore hole parallel to the machine axis for receiving the grinding accessory or cutting accessory. The construction of the attachment part is similar to that of the tool which has been conventionally used for the oscillation machine.

The grinding and cutting accessory is preferably clamped in the receiving bore hole of the mass body by means of at least one clamping screw, e.g., a stud screw, which is screwed in via threaded bore holes which are guided at right angles to the receiving bore hole and extend into the latter. Of course, the clamping effect for the supplementary tools can be increased by providing two stud screws. This clamping screw or these two clamping screws can be arranged laterally at the mass body, i.e., substantially parallel to the attachment surface of the attachment neck. In this way, the clamping stud screws cause the least possible interference and right-handed clamping is possible.

In an advantageous manner, the mass body is arranged eccentrically with respect to the attachment part in such a way that their undersides are substantially aligned in a plane. The oscillating body/intermediate holder accordingly has an L-shaped construction as a whole. As a result of this L-shaped construction, the mass body of the supplementary holder can project out so as to face downward or upward. When the mass body is arranged so as to face upward, the receiving bore hole for the supplementary tools is brought closer to the central axis of the oscillation machine, which benefits machining since a more compact arrangement is achieved as a whole.

Moreover, bevels are advantageously provided at the mass body, especially in the edges located in the insertion direction which may possibly cause obstruction in the working direction. In particular, these edges are the lateral upper and lower edges which are located substantially opposite to the stud clamping screws so that axial insertion and the lateral freedom of movement for forward feed of the tool is optimized.

The operation of the hand-held oscillation machine according to the invention is explained more fully in the following as applied to automobile body construction by way of example:

Sheet metal parts which have been damaged by corrosion are removed and replaced by replacement sheet metal. Before the sheet metal parts can be welded on, the corrosion protection, e.g., primer paint or finish paint, must be removed. Conventionally, paint was heated by a burner and then removed with a wire brush. For this purpose, drilling machines with a grinding attachment and angular grinding machines are used in accessible locations. However, such devices can only be controlled in an imprecise manner so that the thickness of the sheet metal is reduced by grinding or more paint is removed than is necessary. In addition, this manner of working generates dust and flying sparks and is accordingly hazardous to health. It is also necessary to wear protective glasses for this work, which is relatively uncomfortable.

According to the invention, it is now possible to use a hand-held oscillation machine with an oscillating body/intermediate holder and a corresponding grinding attachment. As a result of the rapid oscillation and small stroke of this device, work can be carried out quickly and accurately without generating excessive dust or posing health risks. Protective glasses need only be worn in special cases, e.g., when working overhead.

The invention is explained more fully in the following with reference to an embodiment example shown in the drawing.

BRIEF DESCRIPTION OF THE DRAWINGS

FIG. 3 shows a side view of an intermediate holder;

FIG. 4 shows a top view in the direction of arrow IV in FIG. 3 of the intermediate holder; and FIG. 5 shows a view in the direction of arrow V in FIG. 3 of the intermediate holder.

DETAILED DESCRIPTION OF THE PREFERRED EMBODIMENTS

Figure 1:
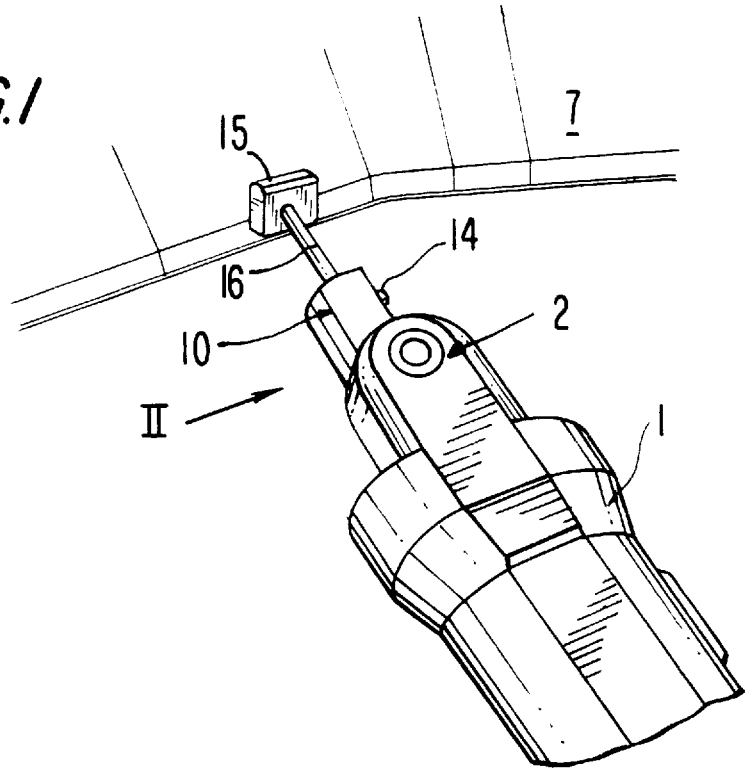
FIG. 1 shows a perspective view of a hand-held oscillation machine according to the invention with an intermediate holder with a grinding tool inserted therein, during the machining of a car body sheet metal part.

It will be seen from FIG. 1 that a hand-held oscillation machine 1 which is used for machining a car body sheet metal part has an attachment neck 2 at its front end at which an oscillating body/supplementary holder 10 is arranged. A grinding tool 15 is fastened in holder 10 by means of the tool shank 16 via clamping stud screws 14.

Figure 2:
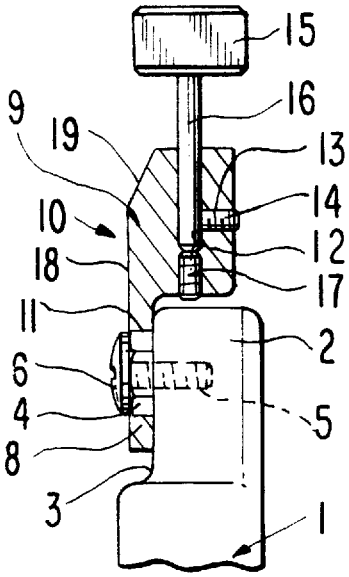
FIG. 2 shows a view in the direction of arrow II from FIG. 1 in partial section, in particular the manner of attaching the oscillating body/intermediate holder to the attachment neck of the machine and the manner of attaching a grinding tool in the latter.

It will be seen from FIG. 2 that the attachment neck 2 has a contact face 3 on one side, and a lower hexagon projection 4 projecting out of the contact face 3. A threaded bore hole 5 is provided centrally in the hexagon projection 4 so that special tools or the intermediate holder 10 can be tightened via a screw 6.

The intermediate holder 10 is substantially formed of a flat attachment part 8 which is somewhat greater in height than the hexagon projection 4 so as to enable a reliable attachment at the neck 2 via the screw 6. A mass body 9 is arranged at the end of the attachment part 8 so as to project over the neck 2 and out on one side, resulting in a substantially L-shaped holder 10. Accordingly, the mass body 9 and the attachment part 8 have a surface lying on a common plane 18. The mass body 9 has a bevel 19 at its front lower edge to facilitate insertion and accordingly to improve the handling of the tool. Further, the mass body 9 has a receiving bore hole 12 which is aligned so as to be parallel to the longitudinal axis of the machine and in which the shank 16 of the tool 15 is inserted.

The shank 16 of the tool 15 is held in the receiving bore hole 12 by clamping stud screws 14 which are guided in threaded bore holes 13 of the mass body 9. A screw 17, which is screwed into the receiving bore hole 12 from the rear end, can be provided as an adjustable axial stop for the tool shank 16.

As can be seen from FIGS. 3 to 5 which show the intermediate holder 10 by itself in three different views, and as has already been mentioned, the intermediate holder 10 is formed of the flat attachment part 8 and the wide mass body 9, but is preferably fashioned from an individual piece, e.g., by cutting, so as to form one piece.

As will be seen from FIG. 4, the flat attachment part 8 has a disk-like rounded portion 21, while the mass body 9 is constructed so as to be narrower and thicker, which facilitates insertion. Additional cut off edges or flattened portions facilitate insertion, e.g., the flattened portion or bevel 22 at the upper lateral edge which likewise facilitates insertion and improves working conditions.

Only one threaded bore hole 13 for a clamping stud screw 14 is provided in the holder shown in FIGS. 3 to 5, while two stud screws 14 are arranged in FIGS. 1 and 2.

Further, it is self-evident that the contact surface 20 of the attachment part 8 passes into the vertical step of the mass body and that the disk-like rounded portion 21 passes into the lateral surfaces of the mass body via corresponding rounded portions or radii 23, respectively, so as to prevent stress corners which is particularly important with respect to oscillations or vibrations.

I claim:

1. A hand-held oscillation machine, comprising:

an attachment neck having a front end formed with a flat side parallel to a longitudinal axis of the machine;

a one piece, oscillating body intermediate holder having a flat attachment part parallel to the longitudinal axis and a mass body, the flat attachment part being attached to the flat side of the front end of the attachment neck, the mass body having a receiving bore hole in which a tool is receivable, the mass body following the flat attachment part in an axial direction of the machine; and means provided at the flat side of the attachment neck for receiving and attaching the holder so that the holder and the tool received therein are rotatably fixed and the tool extends essentially along the longitudinal machine axis.

2. A machine according to claim 1, wherein the receiving and attaching means includes a flattened hexagonal projection provided on the flat side of the attachment neck, and a radial screw provided so as to be threadable into a threaded bore in the hexagonal projection, the attachment part having a hexagonal opening corresponding to the hexagonal projection so that the hexagonal opening of the flat attachment part receives the hexagonal projection, the flat attachment part having a thickness that is greater than that of the hexagonal projection.

3. A machine according to claim 1, wherein the mass body and the attachment part of the holder are configured so as to have bottom sides that are aligned in a plane and so that the holder is substantially L-shaped, the mass body being substantially thicker than the attachment part.

4. A machine according to claim 1, wherein the bore hole is axially parallel to the longitudinal machine axis.

5. A machine according to claim 4, wherein the mass body has at least one threaded bore hole perpendicular to and opening into the receiving bore hole, a clamping screw being arranged in the at least one threaded bore hole whereby the tool shank can be clamped in the receiving bore hole.

6. A machine according to claim 5, wherein the receiving bore hole in the mass body has a forward end and a rearward end, the tool shank being insertable in the forward end, and further comprising a stop screw threaded into the rearward end of the receiving bore hole so as to act as a stop for the tool shank.

7. A machine according to claim 6, wherein the mass body includes at least one beveled surface.

8. A machine according to claim 7, wherein the mass body has a bottom side facing a common direction with the flat side of the attachment neck, and an upper side opposite the bottom side, a front edge of the bottom side being beveled and an upper edge of the upper side opposite the stop screw being beveled.

9. An intermediate holder for holding a tool on a flat front end of a hand-held oscillation machine that extends in a longitudinal direction of the oscillation machine, the holder comprising: a flat attachment part that is engagable with the flat front end of the oscillating machine; and, a mass body attached to a lateral side of the attachment part, the mass body having a bore hole axially parallel to the longitudinal direction of the oscillation machine for receiving a tool shank so that the tool extends substantially along a longitudinal machine axis.

* * * * *